US011122941B2

(12) United States Patent
Palacios

(10) Patent No.: US 11,122,941 B2
(45) Date of Patent: Sep. 21, 2021

(54) WALL MOUNTED SCRUBBER APPARATUS

(71) Applicant: William Palacios, Houston, TX (US)

(72) Inventor: William Palacios, Houston, TX (US)

( * ) Notice: Subject to any disclaimer, the term of this patent is extended or adjusted under 35 U.S.C. 154(b) by 4 days.

(21) Appl. No.: 16/662,982

(22) Filed: Oct. 24, 2019

(65) Prior Publication Data

US 2021/0121025 A1 Apr. 29, 2021

(51) Int. Cl.
*A47K 7/02* (2006.01)
*A47K 7/03* (2006.01)
*A46B 11/00* (2006.01)

(52) U.S. Cl.
CPC ..... *A47K 7/024* (2013.01); *A46B 11/0041* (2013.01); *A47K 7/03* (2013.01)

(58) Field of Classification Search
CPC ..... A47K 7/024; A47K 7/03; A61B 11/0041
See application file for complete search history.

(56) References Cited

U.S. PATENT DOCUMENTS 4,047,259 A * 9/1977 Lotis ..... A47K 7/024 15/104.92
4,053,960 A * 10/1977 Kingswell ..... A47K 7/024 15/104.92
5,228,165 A * 7/1993 Westberry ..... A47K 7/024 15/160
D344,633 S 3/1994 Ali
5,517,705 A * 5/1996 Jackson ..... A47K 7/024 15/104.92
6,427,281 B1 8/2002 Simon
6,568,029 B1 5/2003 Letts
6,647,564 B1 11/2003 Smith
7,120,947 B1 * 10/2006 Magallanes ..... A47K 7/024 4/606
7,175,357 B1 * 2/2007 Brignoni ..... A46B 5/00 4/606
7,472,449 B2 1/2009 Orban
8,142,095 B1 * 3/2012 Cutler ..... A47K 7/03 401/201
8,726,445 B1 5/2014 Wagner
2006/0107473 A1 * 5/2006 Torres ..... A47K 7/024 15/21.1
2008/0250594 A1 * 10/2008 Green ..... A47K 7/024 15/210.1
2009/0113616 A1 * 5/2009 Daly, Sr. ..... A46B 11/0058 4/606

(Continued)

FOREIGN PATENT DOCUMENTS

GB 2375478 * 11/2002 ..... A47K 7/03

*Primary Examiner* — J C Jacyna

(57) ABSTRACT

A wall mounted scrubber apparatus for cleaning and exfoliating includes a base having a front side, a back side, a top side, a bottom side, a left side, and a right side defining a base inside. The top side has an intake aperture extending through to the base inside and the front side has a plurality of output apertures extending through to the base inside. The base inside is configured to hold a liquid soap and release said liquid soap through the plurality of output apertures. A cap is selectively engageable with the intake aperture. A plurality of suction cups is coupled to the back side and is configured to secure the base to a shower wall. A plurality of brushes is coupled to the base. Each brush comprises a cluster of bristles coupled to the front side of the base around one of the output apertures.

7 Claims, 6 Drawing Sheets

(56) References Cited

U.S. PATENT DOCUMENTS

| | | | | |
|---|---|---|---|---|
| 2011/0056038 | A1 | 3/2011 | Cooper | |
| 2012/0066856 | A1 | 3/2012 | Watford | |
| 2016/0287031 | A1 | 10/2016 | Williams | |
| 2020/0178736 | A1* | 6/2020 | Reynolds | A47K 7/024 |

* cited by examiner

WALL MOUNTED SCRUBBER APPARATUS

(b) CROSS-REFERENCE TO RELATED APPLICATIONS

Not Applicable

(c) STATEMENT REGARDING FEDERALLY SPONSORED RESEARCH OR DEVELOPMENT

Not Applicable

(d) THE NAMES OF THE PARTIES TO A JOINT RESEARCH AGREEMENT

Not Applicable

(e) INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

(f) STATEMENT REGARDING PRIOR DISCLOSURES BY THE INVENTOR OR JOINT INVENTOR

Not Applicable

(g) BACKGROUND OF THE INVENTION

(1) Field of the Invention

The disclosure relates to hygiene devices and more particularly pertains to a new hygiene device for cleaning and exfoliating.

(2) Description of Related Art Including Information Disclosed Under 37 CFR 1.97 and 1.98

The prior art relates to hygiene devices.

(h) BRIEF SUMMARY OF THE INVENTION

An embodiment of the disclosure meets the needs presented above by generally comprising a base having a front side, a back side, a top side, a bottom side, a left side, and a right side defining a base inside. The top side has an intake aperture extending through to the base inside and the front side has a plurality of output apertures extending through to the base inside. The base inside is configured to hold a liquid soap and release said liquid soap through the plurality of output apertures. A cap is selectively engageable with the intake aperture. A plurality of suction cups is coupled to the back side and is configured to secure the base to a shower wall. A plurality of brushes is coupled to the base. Each brush comprises a cluster of bristles coupled to the front side of the base around one of the output apertures.

An alternative embodiment of the disclosure generally comprises a base having a front side, a back side, a top side, a bottom side, a left side, and a right side defining a base inside. The top side has an intake aperture extending through to the base inside and the front side has a plurality of output apertures extending through to the base inside. The base inside is configured to hold a liquid soap and release said liquid soap through the plurality of output apertures. A cap is selectively engageable with the intake aperture. A plurality of suction cups is coupled to the back side and is configured to secure the base to a shower wall. A loofah is coupled to the front side of the base and covers the plurality of output apertures.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

(i) BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

(j) DETAILED DESCRIPTION OF THE INVENTION

Figure 1:
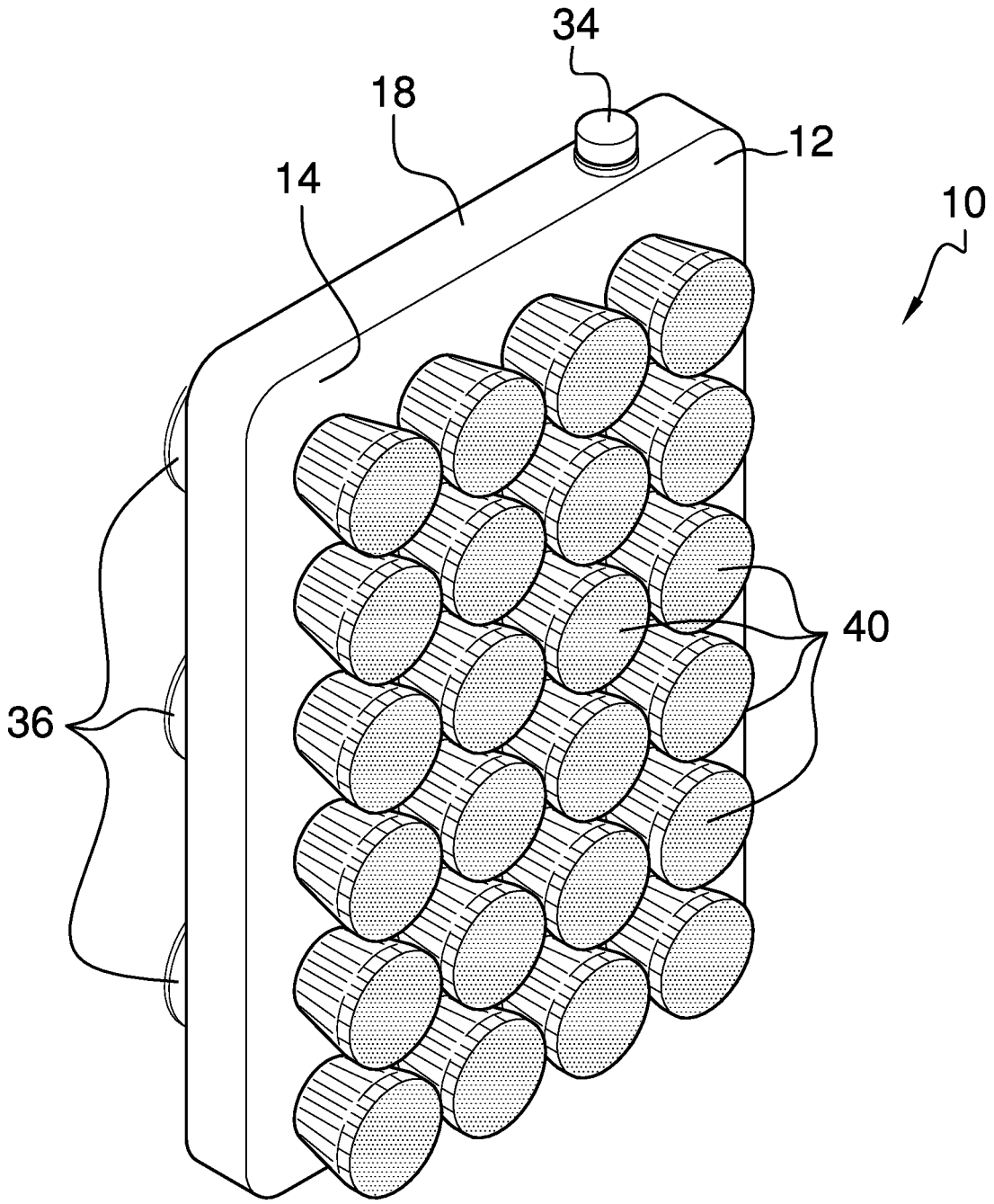
FIG. 1 is an isometric view of a wall mounted scrubber apparatus according to an embodiment of the disclosure.
Figure 2:
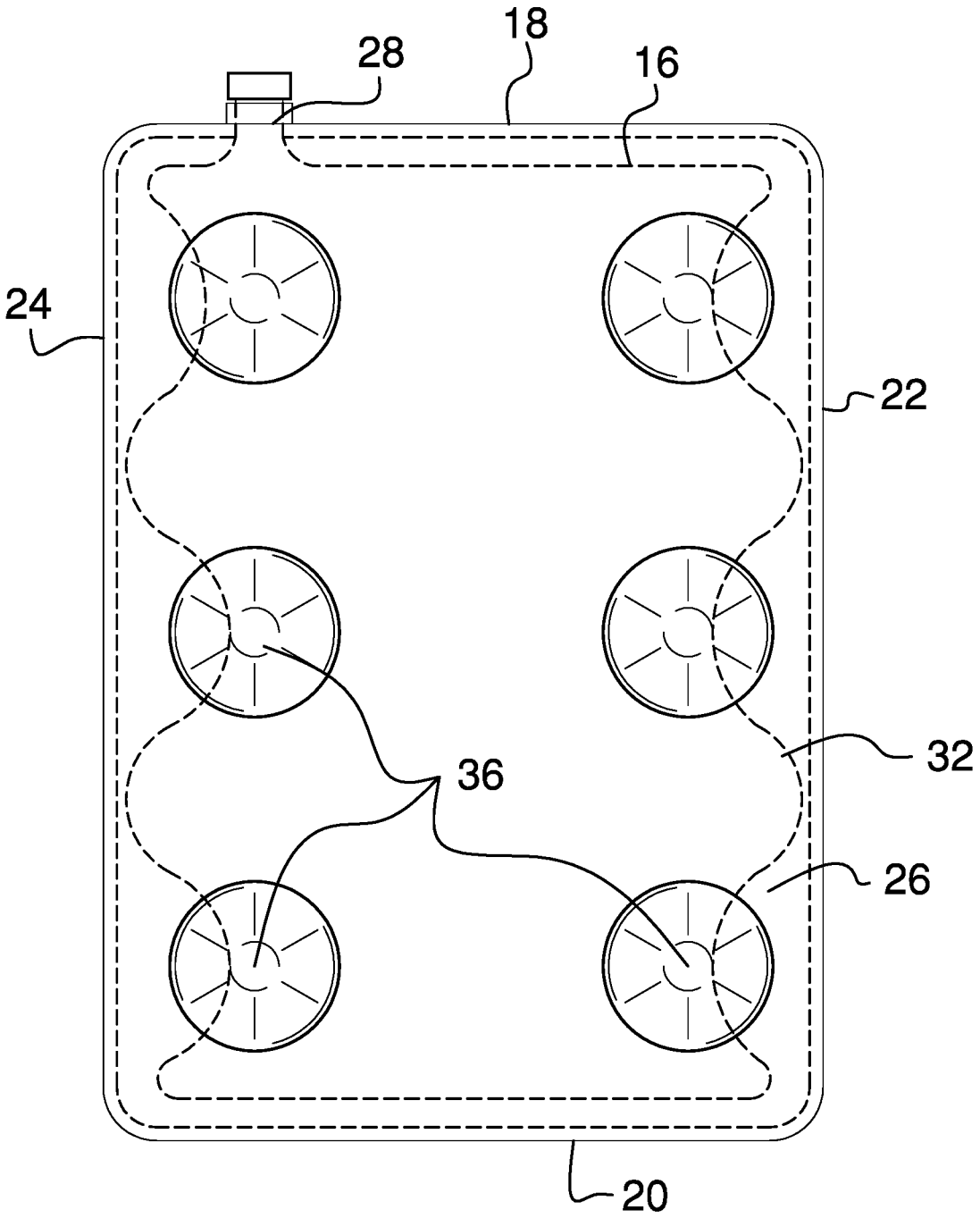
FIG. 2 is a rear elevation view of an embodiment of the disclosure.
Figure 3:
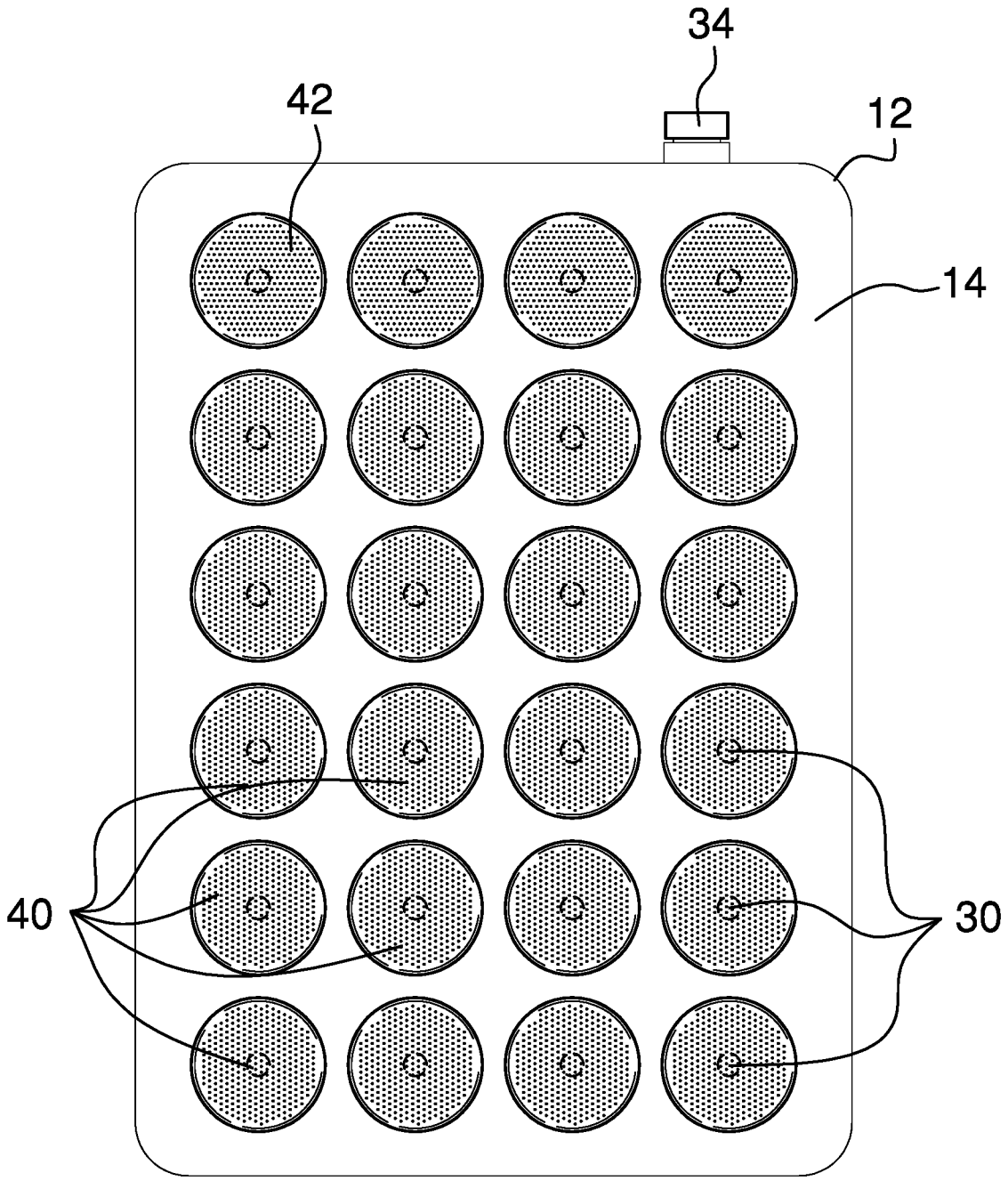
FIG. 3 is a front elevation view of an embodiment of the disclosure.
Figure 4:
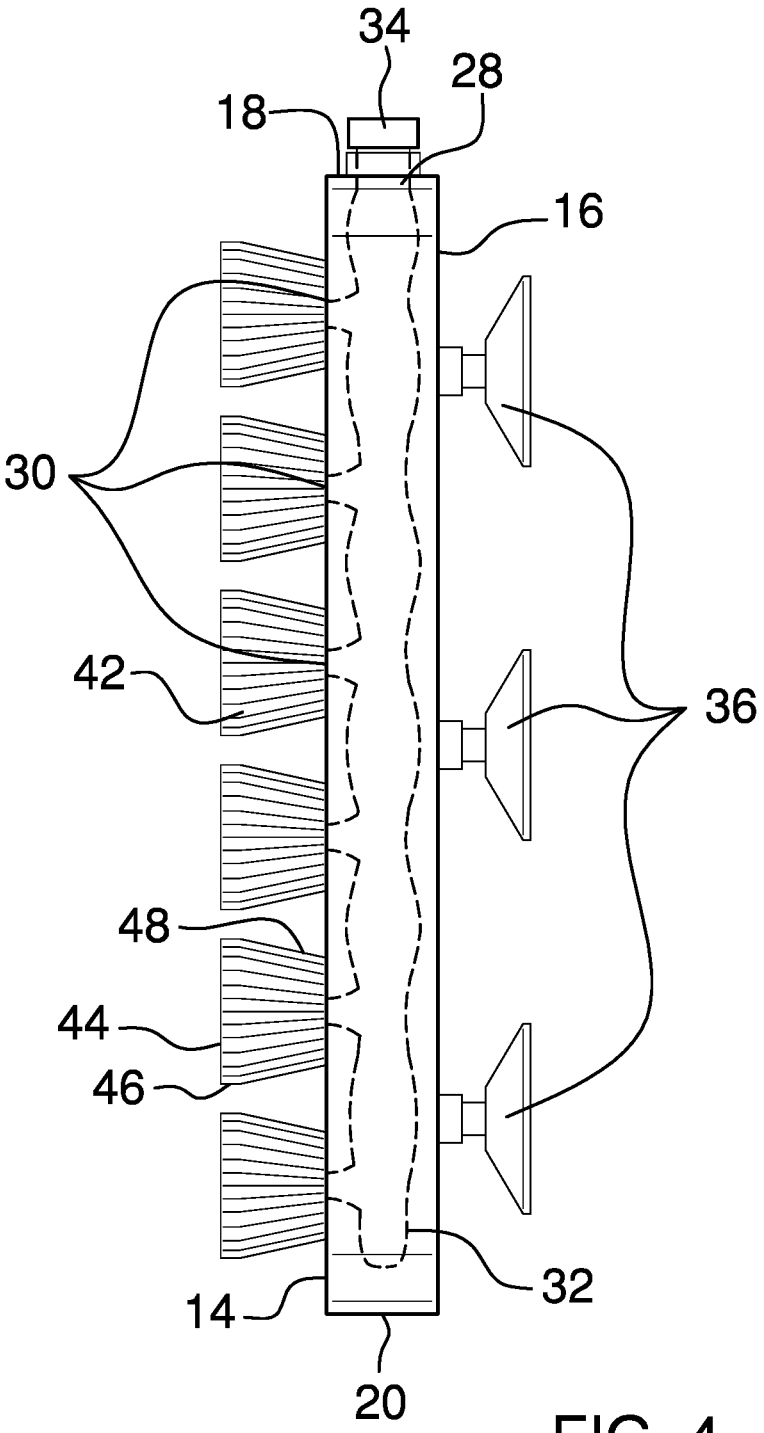
FIG. 4 is a side elevation view of an embodiment of the disclosure.
Figure 5:
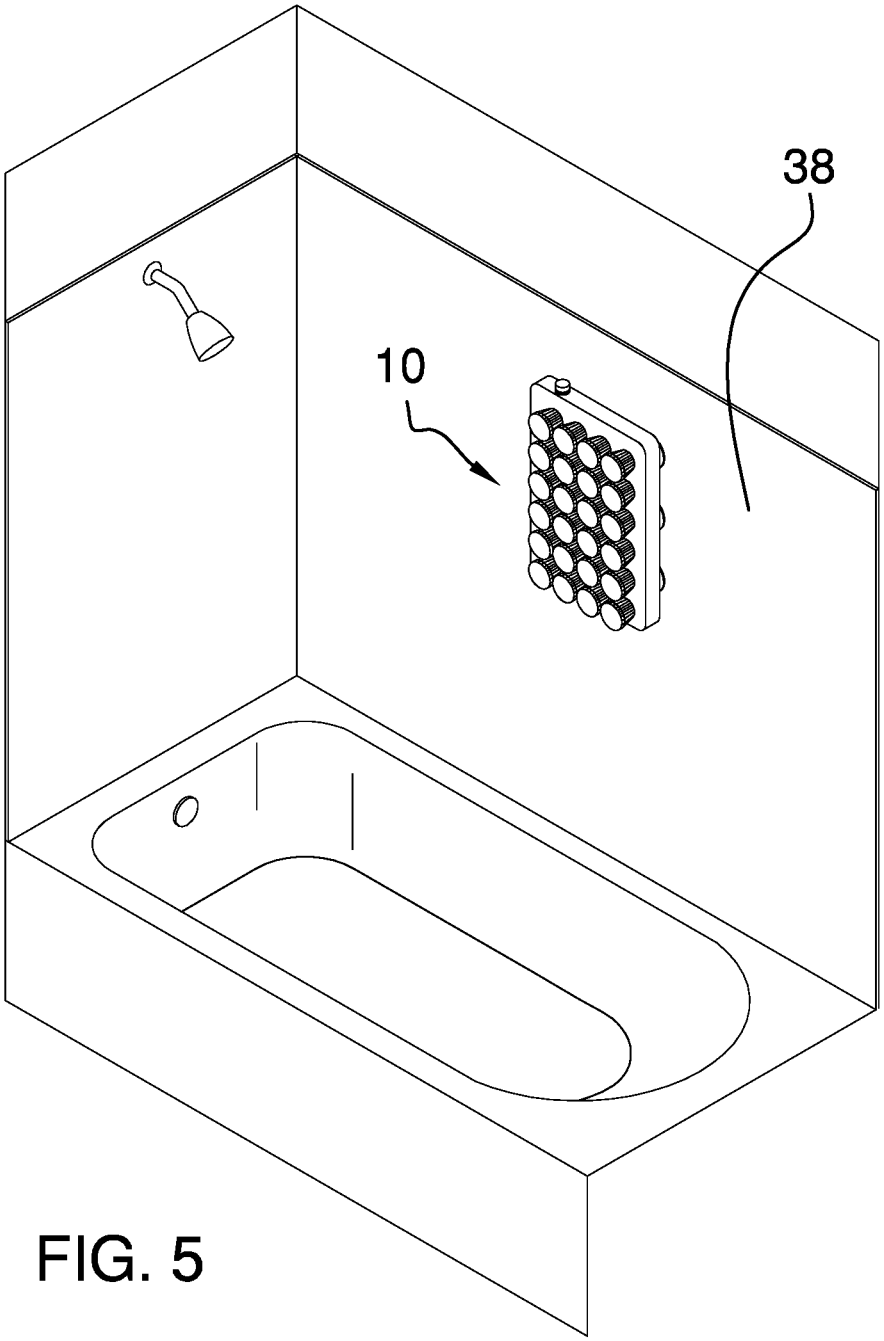
FIG. 5 is an in-use view of an embodiment of the disclosure.
Figure 6:
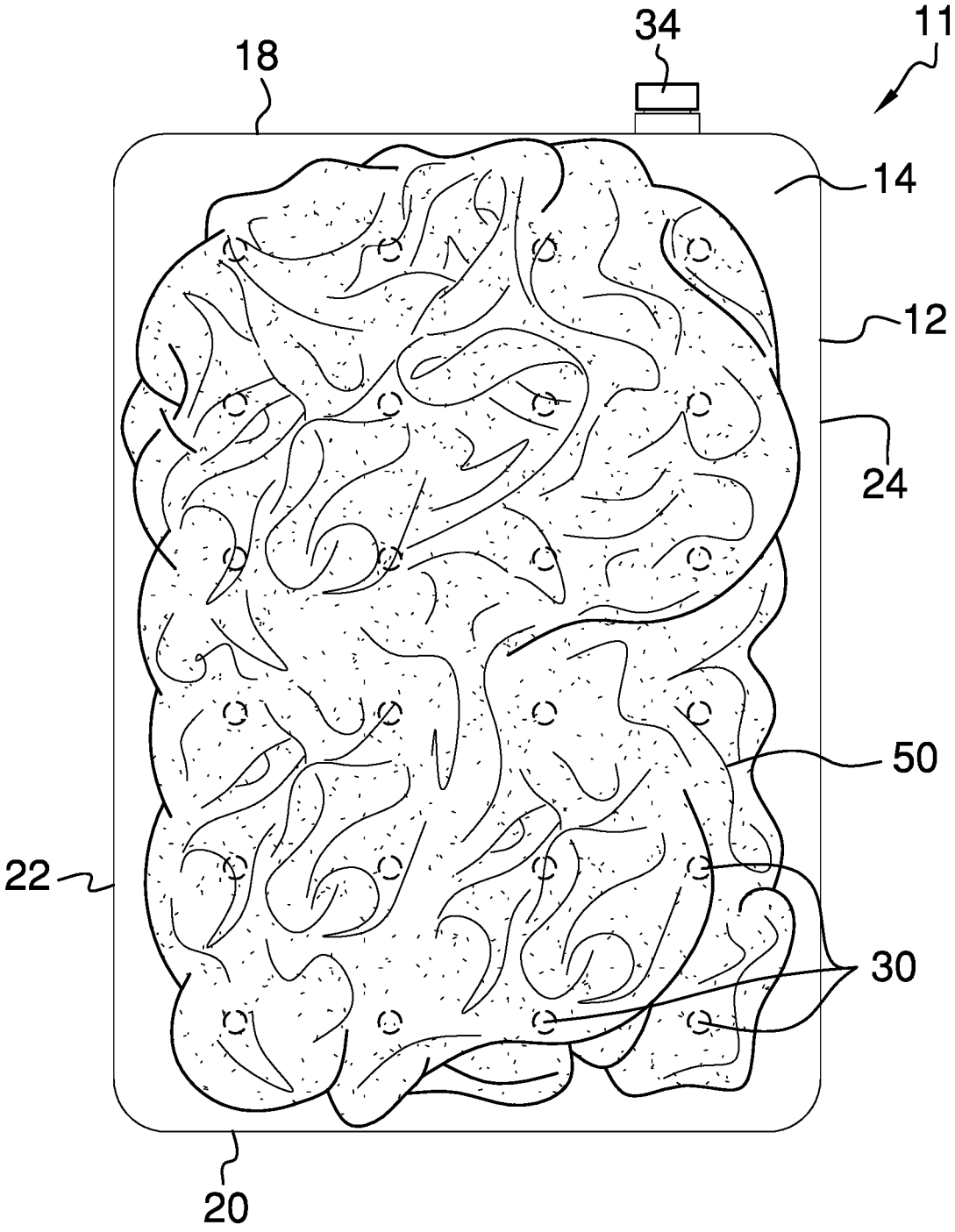
FIG. 6 is a front elevation view of an embodiment of the disclosure.

With reference now to the drawings, and in particular to FIGS. 1 through 6 thereof, a new hygiene device embodying the principles and concepts of an embodiment of the disclosure and generally designated by the reference numeral 10 will be described.

As best illustrated in FIGS. 1 through 6, the wall mounted scrubber apparatus 10 generally comprises a base 12 having a front side 14, a back side 16, a top side 18, a bottom side 20, a left side 22, and a right side 24 defining a base inside 26. The front side 14 and the back side 16 may have rounded corners to prevent user discomfort. The top side 18 has an intake aperture 28 extending through to the base inside 26 and the front side 14 has a plurality of output apertures 30 extending through to the base inside 26. The plurality of output apertures 30 may be arranged in a matrix. The number of rows of the output apertures 30 may be 50% greater than the number of columns of the output apertures 30.

A bladder 32 may be coupled within the base inside 26. The bladder 32 is in fluid communication with the intake aperture 28 and each of the output apertures 30. The bladder 32 is configured to hold a liquid soap and release said liquid soap through the plurality of output apertures 30. The base 12 may be malleable to allow pressure applied to the front side 14 to squeeze the bladder 32 and eject more liquid soap through the output apertures 30. A cap 34 is coupled to the base 12. The cap 34 is selectively engageable with the intake aperture 28. A plurality of suction cups 36 is coupled to the back side 16 of the base and is configured to secure the base 12 to a shower wall 38. The plurality of suction cups 36 may be six suction cups 36.

A plurality of brushes 40 is coupled to the base 12. Each brush 40 comprises a cluster of bristles 42 coupled to the front side 14 of the base around one of the output apertures 30. Each brush 40 may have a circular outer face 44, a cylindrical shoulder portion 46, and a tapered neck portion 48 extending back towards the front side 14 of the base. In an alternative embodiment of the invention 11 a loofah 50 is coupled to the base 12 rather than the plurality of brushes 40. The loofah 50 is coupled to the front side 14 of the base and covers the plurality of output apertures 30.

In use, the bladder 32 is filled with liquid soap through the intake aperture 28 and the cap 34 is used to seal the base inside 26. The plurality of suctions cups 36 is used to mount the base 12 to the shower wall 38. While showering, a user can press his back against the plurality of brushes 40 or the loofah 50 to release the liquid soap through the output apertures 30 and to easily clean and exfoliate difficult to reach places.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A wall mounted scrubber apparatus comprising:

a base, the base having a front side, a back side, a top side, a bottom side, a left side, and a right side defining a base inside, the top side having an intake aperture extending through to the base inside and the front side having a plurality of output apertures extending through to the base inside, the base inside being configured to hold a liquid soap and release said liquid soap through the plurality of output apertures;

a cap coupled to the base, the cap being selectively engageable with the intake aperture;

a plurality of suction cups coupled to the base, the plurality of suction cups being coupled to the back side and configured to secure the base to a shower wall;

a plurality of brushes coupled to the base, each brush comprising a duster of bristles coupled to the front side of the base around one of the output apertures; and a bladder coupled within the base inside, the bladder being in fluid communication with the intake aperture and each of the output apertures, the bladder being configured to hold the liquid soap and release said liquid soap through the plurality of output apertures, the bladder having undulating front and rear faces and an undulating peripheral edge extending around the front and rear faces, each output aperture being environmentally coupled to the front face of the bladder between undulations such that the front face is convex between adjacent output apertures aligned perpendicular to the and extending between the top side and the bottom side of the base.

2. The wall mounted scrubber apparatus of claim 1 further comprising each brush having a circular outer face, a cylindrical shoulder portion, and a tapered neck portion extending back towards the front side of the base.

3. The wall mounted scrubber apparatus of claim 1 further comprising the plurality of output apertures being arranged in a matrix.

4. The wall mounted scrubber apparatus of claim 3 further comprising the number of rows of the output apertures being 50% greater than the number of columns of the output apertures.

5. The wall mounted scrubber apparatus of claim 1 further comprising the plurality of suction cups being six suction cups.

6. The wall mounted scrubber apparatus of claim 1 further comprising the front side and the back side having rounded corners.

7. A wall mounted scrubber apparatus comprising:

a base, the base having a front side, a back side, a top side, a bottom side, a left side, and a right side defining a base inside, the front side and the back side having rounded corners, the top side having an intake aperture extending through to the base inside and the front side having a plurality of output apertures extending through to the base inside, the plurality of output apertures being arranged in a matrix;

a bladder coupled within the base inside, the bladder being in fluid communication with the intake aperture and each of the output apertures, the bladder being configured to hold a liquid soap and release said liquid soap through the plurality of output apertures, the bladder having undulating front and rear faces and an undulating peripheral edge extending around the front and rear faces such that the front face is convex between adjacent output apertures aligned perpendicular to the and extending between the top side and the bottom side of the base;

a cap coupled to the base, the cap being selectively engageable with the intake aperture;

a plurality of suction cups coupled to the base, the plurality of suction cups being coupled to the back side and configured to secure the base to a shower wall; and a plurality of brushes coupled to the base, each brush comprising a cluster of bristles coupled to the front side of the base around one of the output apertures, each brush having a circular outer face, a cylindrical shoulder portion, and a tapered neck portion extending back towards the front side of the base.

* * * * *